United States Patent [19]

Bulgier

[11] 4,449,830

[45] May 22, 1984

[54] METHOD AND APPARATUS FOR MEASURING ELAPSED TIME BETWEEN AN INITIATING EVENT AND A DEPENDENT EVENT

[75] Inventor: Lawrence W. Bulgier, West Suffield, Conn.

[73] Assignee: Combustion Engineering, Inc., Windsor, Conn.

[21] Appl. No.: 288,842

[22] Filed: Jul. 31, 1981

[51] Int. Cl.[3] ..... G04F 8/00; G04F 10/00

[52] U.S. Cl. ..... 368/119; 368/46; 368/105

[58] Field of Search ..... 368/46, 52, 59, 60, 368/119, 107, 108, 113, 121; 375/106, 110, 114; 179/2 TC

[56] References Cited

U.S. PATENT DOCUMENTS

| | | | |
|---|---|---|---|
| 3,444,461 | 5/1969 | Amano et al. | 368/119 |
| 3,690,059 | 9/1972 | Haydon | 368/52 |
| 4,180,724 | 12/1979 | Councilman et al. | 368/118 |
| 4,322,831 | 3/1982 | Peterson | 368/46 |

FOREIGN PATENT DOCUMENTS

| | | | |
|---|---|---|---|
| 930727 | 7/1963 | United Kingdom | 368/46 |

*Primary Examiner*—Bernard Roskoski

*Attorney, Agent, or Firm*—David L. Smith; Robert L. Olson

[57] ABSTRACT

A timer system (10,110,210) of two or more timers (10,110,210) measures the response time between an initiating event and a dependent event. The initiating and dependent events may be physically separated or electrically isolated. The timer system (10,110,210) permits recording of associated initiating and dependent events for a response time test followed by the recording of additional associated initiating and dependent events for additional response time tests while the timers remain separated. Thus, the timer system (10,110,210) permits serial recording of information for a large number of response time tests. The timers (10,110,210) may be identical. The timers (10,110,210) are interconnected and synchronized, then disconnected and separated to record the time of occurrence of the physically separated or electrically isolated events. The timers (10,110,210) are then again interconnected for a simultaneous recording of the elapsed time on each timer. A correction is made in the recorded time of occurrence of the events on all but one timer (10,110,210) to compensate for the differences in elapsed time. The response time between initiating and dependent events is then calculated to a common time base. The timer system (10,110,210) can also be used to record analog signals (68,72,74,168,172,174) to a common time base or as a conventional timer (10,110,210) to time an event from start (60) to finish (62).

8 Claims, 9 Drawing Figures

METHOD AND APPARATUS FOR MEASURING ELAPSED TIME BETWEEN AN INITIATING EVENT AND A DEPENDENT EVENT

BACKGROUND OF THE INVENTION

The invention relates to response time testing of nuclear power plant equipment, and in particular to the measurement of elapsed time between the occurrence of a plurality of associated, physically separated, or electrically isolated events.

Response time is the elapsed time between the occurrence of an initiating event and a dependent event in which the dependent event occurs in response to the initiating event. For example, the elapsed time between when an operator intiates the closing of a valve by changing the position of a switch in the control room and the time the closed limit switch on the valve indicates the valve has closed. Response time can involve more than two associated events. A single initiating event may have more than one associated dependent event; a dependent event may be the initiating event for a subsequent dependent event. It may be desired to know when the pressure downstream of the valve has decreased to a desired level relative to when the operator initiated closing the valve or relative to when the valve was proven closed by the close limit switch. Response time testing is the determination of the elapsed time between the occurrence of the associated events.

Existing timers generally measure the elapsed time between a start signal and a stop signal. The start and stop signals may be mechanically or electrically intiated. When they are electrically initiated, the electrical start and stop signals are measured relative to a common ground and are wired back to the timer at a single location.

Response time testing can be performed using conventional timers by starting two conventional timers simultaneously and then stopping them by physically separated or isolated events. The first timer would stop timing upon the occurrence of the initiating event; the second timer would stop timing upon the occurrence of the dependent event. The difference in elapsed time between the two timers is the response time. There is, however, no way to time additional pairs of events while the timers are separated. The timers must be taken back to a common location and again simultaneously started to perform another response time test. Alternatively, a pair of electrical conductors can be taken with each timer to accommodate simultaneously restarting the timers after one response time test in preparation for another response time test. Either of these alternatives becomes cumbersome when response time testing the many pieces of equipment in preparation for plant startup of a nuclear power plant.

SUMMARY OF THE INVENTION

A timer system using a plurality of physically and electrically separable timers can be used in response time testing to measure the elapsed time between associated initiating and dependent, physically separated or electrically isolated events. Response time testing using this timer system is not limited to a single group of associated initiating and dependent events, but after recording of one group of associated initiating and dependent events has concluded, additional groups of associated initiating and dependent events can be recorded serially.

The timers may be identical, can be built with off-the-shelf components and each timer includes a self contained power supply, an oscillator, a clock register, a snapshot register and a display. A plurality of timers are interconnected and the clock registers of all timers are simultaneously reset to zero. A clock register increases its stored number by one for each pulse received from the oscillator. The pulse counting clock register is not reset when a recording is taken but rather the pulse counting clock register continues to count upwardly from the time the clock registers were simultaneously reset to zero.

After being synchronized, the timers are separated and used to record the time of occurrence of events in a series of response time tests. An event time of occurrence is recorded on a timer by transferring the number stored in the clock register to the snapshot register. This transfer can be effecuated by a pushbutton or an electric signal.

After the serial recording of groups of associated initiating and dependent events has concluded, the plurality of timers are again interconnected for a simultaneous recording of the elapsed time on each of the timers. The elapsed time on one timer is taken as absolute time. The time of occurrence of events as recorded on the other timers is adjusted on a prorated basis depending upon the elapsed time of the timer on which the signal was recorded relative to the elapsed time of the timer taken as absolute time and the time of occurrence of the event between time of synchronization and the total elapsed time. The response time of each of the groups of initiating and dependent events is then calculated.

The timers of the present invention can also be used as conventional timers to measure elapsed time between a start signal and a stop signal or to record analog signals to a common time base on physically separated or electrically isolated recorders.

DESCRIPTION OF THE PREFERRED EMBODIMENT

Figure 1:
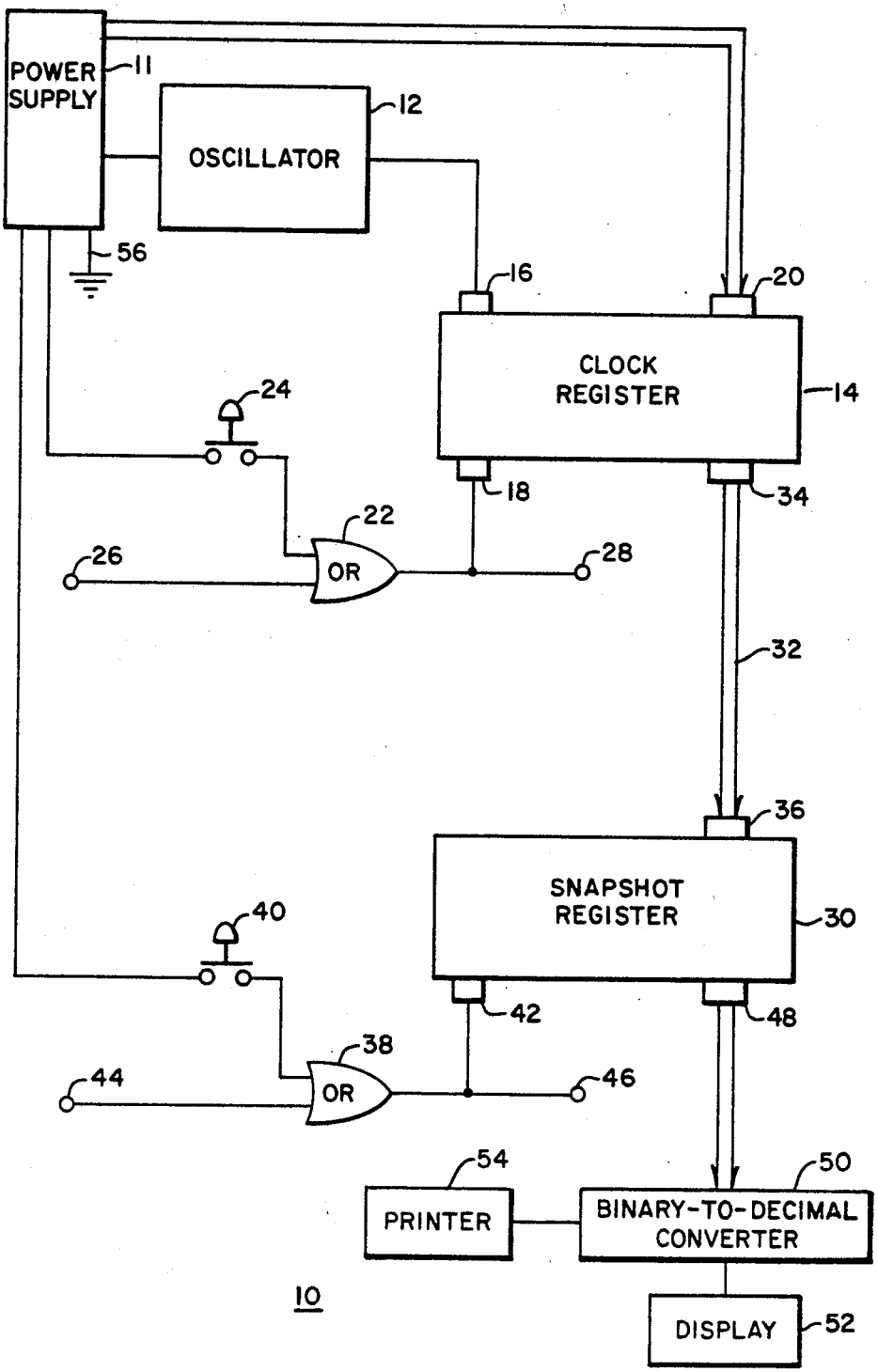
FIG. 1 is a schematic diagram of a timer in accordance with the present invention.

FIG. 1 is a schematic diagram of timer 10. Power supply 11 energizes oscillator 12 which generates periodic pulses of a known frequency. A typical oscillator is a Dale X0-11A-XXX, where XXX is the desired frequency in megahertz. Clock register 14 receives the pulses produced by oscillator 12 at its count-in terminal 16 and increases its stored number by one for each pulse it receives from oscillator 12. A typical clock register is Fairchild TTL/MSI 9366/54193.

Upon receiving a momentary logic 1 at reset terminal 18, clock register 14 resets its stored number to the value at data-in terminal 20. It is preferred that the value at the data-in terminal 20 be zero so that the number stored in clock register 14 becomes zero at each bit when clock register 14 is reset. The reset signal originates from either of the inputs to OR gate 22. A typical OR gate is Fairchild or TTL 7432. The first input to OR gate 22 is a logic 1 that originates from power supply 11 and passes through pushbutton switch 24 when pushbutton switch 24 is pressed. The second input to OR gate 22 originates from an external source and resets clock register 14 through input terminal 26. The reset signal is also available at output terminal 28. After resetting, clock register 14 resumes counting pulses from oscillator 12.

Snapshot register 30 is similar to clock register 14 except that snapshot register 30 has no count-in terminal. A typical snapshot register is Fairchild or Texas Instruments (TI) TTL 7495. The data-in lines 32 for snapshot register 30 are connected to the state output terminals 34 of clock register 14. Upon receipt of the logic 1 at reset terminal 42 of snapshot register 30, the number of counted clock pulses stored in clock register 14 is transferred to data-in terminals 36 of snapshot register 30.

The reset signal for snapshot register 30 is constructed in a manner similar to the reset signal for clock register 14. The first input to OR gate 38 is a logic 1 that originates from power supply 11 and passes through pushbutton switch 40 when pushbutton switch 40 is depressed and is received at reset terminal 42 of snapshot register 30. The second input to OR gate 38 originates from an external source and resets snapshot register 30 through input terminal 44. Snapshot register 30 is reset to the number stored in clock register 14 and available to snapshot register 30 at data-in terminals 36. The snapshot register 30 reset signal is also available at output terminal 46. After resetting snapshot register 30, snapshot register 30 maintains the number transferred from clock register 14 until reset terminal 42 of snapshot register 30 again receives a momentary logic 1. Upon the receipt of each successive logic 1 at reset terminal 42 of snapshot register 30, the number stored in snapshot register 30 is replaced with the current number of counted clock pulses stored in clock register 14.

The state output terminals 48 of snapshot register 30 are connected to binary-to-decimal converter 50. The binary-to-decimal converter 50 converts the binary number contained in snapshot register 30 to a decimal number for display. The binary-to-decimal converter 50 is connected to a display 52 and preferably to either a built-in or an external printer 54.

The signal ground 56 is the signal to which all voltages are referred. It is shown because of its important role in recording physically separated or electrically isolated signals.

Timer 10 includes self contained power supply 11. Power supply 11 provides power for oscillator 12, clock register 14, snapshot register 30, binary-to-decimal converter 50, display 52 and printer 54. In addition, power supply 11 generates the logic 1 signal that appears before pushbutton switch 24 and pushbutton switch 40, the reference number at the data-in terminals 20 of clock register 14, and the signal ground 56.

Figure 2:
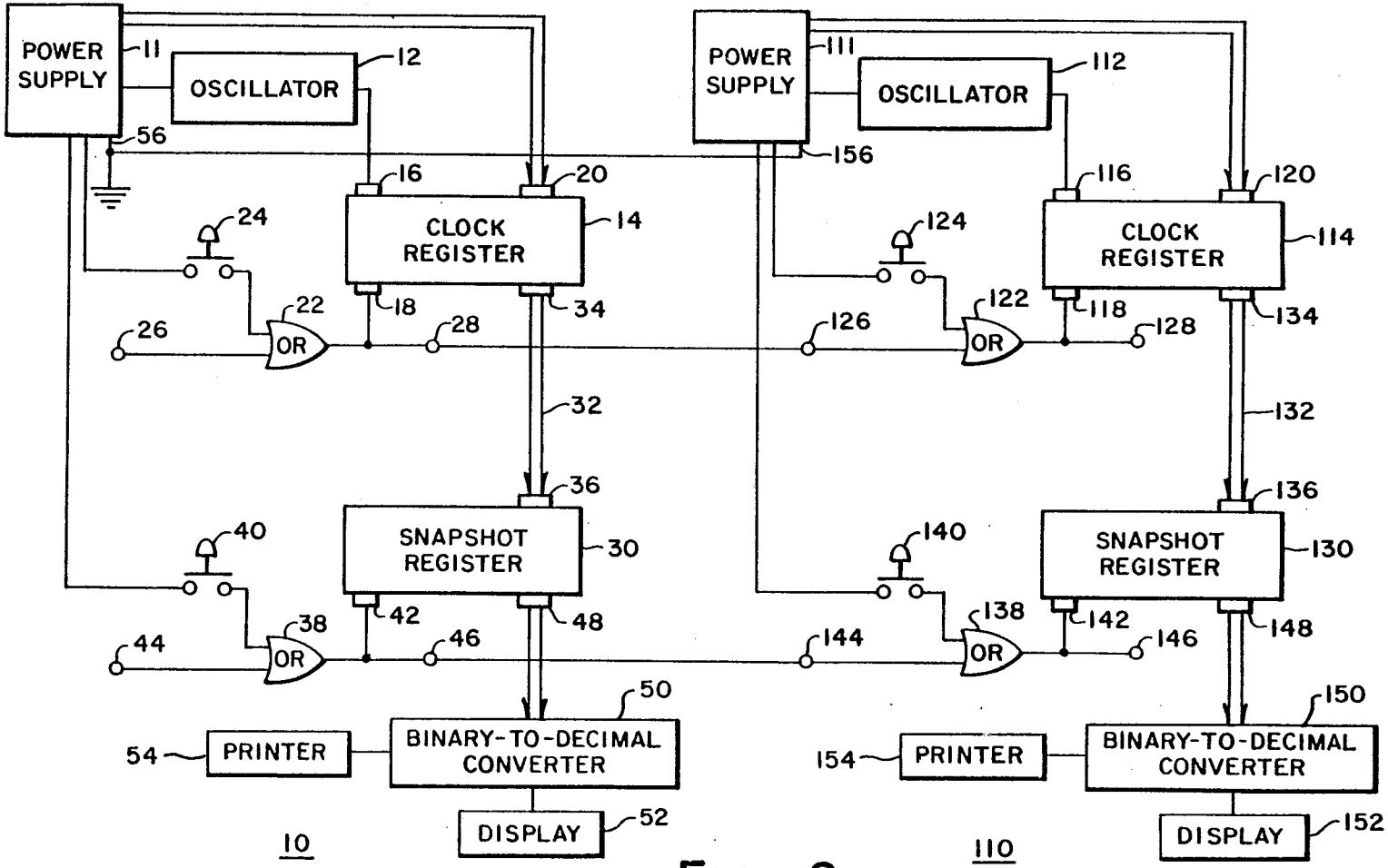
FIG. 2 is a schematic diagram showing two timers interconnected in the synchronization phase.
Figure 3:
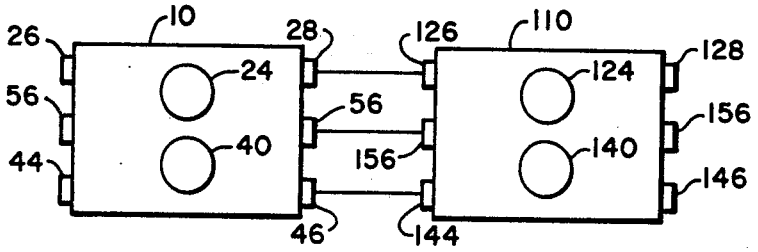
FIG. 3 is a simplified schematic diagram of the two timers in FIG. 2.

FIG. 2 shows two timers as described above that have been interconnected to permit simultaneous resetting of the clock registers. FIG. 3 shows the same timers as FIG. 2 in a more simplified schematic diagram. The two timers of FIG. 2 have been designated timer 10 and timer 110. As shown in FIG. 2, timer 10 acts as the master timer and timer 110 acts as the slave timer during synchronization; the role of the two timers could be reversed.

This timing system can be used where oscillator 12 of timer 10 and oscillator 112 of timer 110 are of different but known frequencies. The difference in frequency creates a cumulative error in counted clock pulses that is more evident and greater after long time periods. There may be applications where different frequency oscillators have advantageous application.

It is contemplated that the usual case encountered will be a specific case of the general case above. In the specific case a plurality of timers will be used with oscillators that are of a known frequency and identical in manufacturer specifications. In this specific case, the correction phase corrects for small differences in frequency of otherwise identical oscillators. The remainder of this description addresses the more narrow specific case. However, one should not lose sight of the potential of the more general case.

As shown in FIG. 2, during the synchronization phase, outputs 28 and 46 of timer 10 are connected to inputs 126 and 144 of timer 100. The signal ground 56 of timer 10 and the signal ground 156 of timer 110 are also connected. Depressing pushbutton switch 24 of timer 10 simultaneously resets clock register 14 of timer 10 and clock register 114 of timer 110. Depressing pushbutton switch 40 of timer 10 will take simultaneous snapshots of the number of counted clock pulses stored in clock register 14 of timer 10 and clock register 114 of timer 110 to verify that the timers are synchronized. The above-mentioned interconnections between timer 10 and timer 110 are then disconnected.

Figure 5:
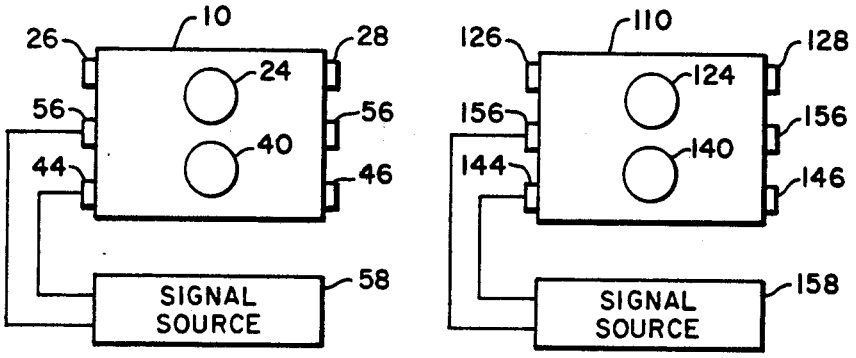
FIG. 5 is a schematic diagram of the two timers of FIG. 3 conducting response time tests between physically separated or electrically isolated signal sources in recording the time of each event.

In the test phase shown in FIG. 5, timer 10 is connected to signal source 58 and timer 110 is connected to signal source 158. Signal sources 58 and 158 represent a pair of associated events that are being response time tested. Signal sources 58 and 158 may be the first pair, an intermediate pair, or the last pair in a series of events being response time tested. By way of example, signal source 58 is a switch in the control room that initiates the opening and closing of a valve, not shown. Timer 10 records when the switch changes position indicating opening the valve relative to the simultaneous resetting of clock registers 14 and 114.

The logic 1 signal necessary at reset terminal 42 to transfer the number of counted clock pulses stored from clock register 14 to snapshot register 30 is generated either locally by power supply 11 or by signal source 58. The logic 1 signal is wired through an unused or auxilliary contact on the control room switch to input terminal 44.

Signal source 158 represents the valve open limit switch. Timer 110 records when the open limit switch indicates the valve is open relative to the simultaneous resetting of clock registers 14 and 114. The logic 1 signal necessary at reset terminal 142 to transfer the number of counted clock pulses from clock register 114 to snapshot register 130 is generated either locally by power supply 111 or by signal source 158. The logic 1 signal is wired through an unused or auxiliary contact on the valve open limit switch to input terminal 144.

The time of occurrence of several pairs of associated events may be recorded serially on timers 10 and 110 all relative to a single simultaneous resetting of clock registers 14 and 114.

Figure 6:
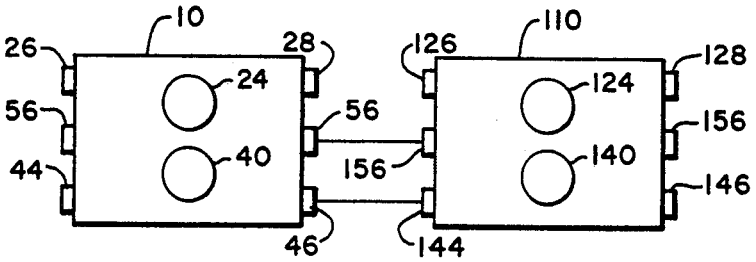
FIG. 6 is a schematic diagram of the two timers of FIG. 3 interconnected to simultaneously record the elapsed time on each of the timers following the response time tests.

In the elapsed time measurement phase, timer 10 and timer 110 are again interconnected after the testing concludes. As shown in FIG. 6, output terminal 46 of timer 10 is connected to input terminal 144 of timer 110. The signal grounds 56 and 156 are also connected. Timer 10 is the master timer and timer 110 is the slave timer in this configuration. The master-slave role may be different from the master-slave role in the synchronization phase of FIG. 3. Either timer may be the master timer and either timer may be the slave timer. Pushbutton switch 40 of timer 10 is depressed to take simultaneous snapshots of the number of counted clock pulses stored in clock register 14 of timer 10 and of clock register 114 of timer 110. These numbers are recorded after all testing is completed; they represent the elapsed time of the respective timers. The testing may have required a few minutes or several hours may have elapsed. These readings will probably differ slightly even if oscillators 12 and 112 were very precise oscillators and were identical in manufacturer specifications.

Finally, in the correction phase, one of the two elapsed times is taken as absolute time and the recorded times of the second timer are adjusted on a prorated basis to account for the difference in elapsed time. Which elapsed time is taken as absolute time is a matter of test strategy. It is preferred that the larger elapsed time be taken as absolute time as this will result in a larger response time that is more conservative from the viewpoint of safety.

The response time for each response time test is calculated by subtracting the earlier of the associated times recorded on one timer from the later of the associated times recorded on the other timer after adjusting for the different oscillator rates measured in the elapsed time measurement phase. The adjustment for the different oscillator rates makes the accuracy of the measurement depend only on the uniformity of the oscillator rates during the measurement and not on their absolute accuracy.

Figure 4:
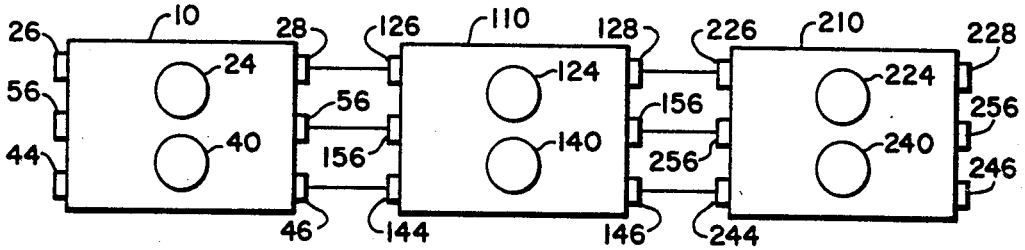
FIG. 4 is a simplified schematic diagram of three timers interconnected in the synchronization phase.
Figure 7:
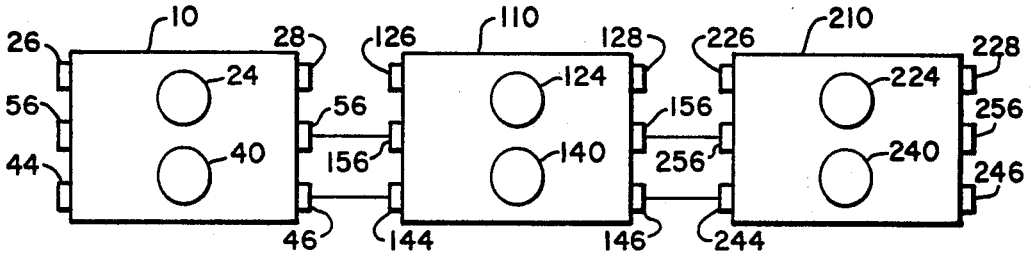
FIG. 7 is a schematic diagram of the three timers of FIG. 4 interconnected for simultaneous recording of the elapsed time on each of the timers.

The above description describes how two timers may be used in response time testing. This concept is not limited to two timers but may be extended to a plurality of timers. When using a plurality of timers in response time testing, only one timer is wired as the master timer and all other timers are wired as slave timers in the synchronization and elapsed time measurement phases. FIG. 4 is a schematic diagram showing the three timers, 10, 110 and 210, interconnected in the synchronization phase. FIG. 7 is a schematic diagram showing three timers interconnected in the elapsed time measurement phase.

For example, three timers could be synchronized. The first timer could be taken to the control room and wired to a switch that operates a valve. The second timer could be taken to the valve and wired to the valve closed limit switch. The third timer could be wired to a pressure transducer to determine when the pressure downstream of the valve drops below a threshold due to closing the valve. Upon tripping the valve to close from the control room, the first recorder will record the time of occurrence of the switch changing position with reference to the synchronization time of three timers. The second timer will transfer to its snapshot register the time of occurrence of the valve reaching its closed position relative to the synchronization time of its three recorders. The third timer will transfer to its snapshot register the time of occurrence of the pressure dropping below the predetermined threshold relative to the synchronization time of the three timers. Additional tests may be performed that may require from minutes to hours to complete and use from two timers to the maximum number of timers synchronized during the synchronization phase. The timers are then brought back together and wired as shown in FIG. 7 and a simultaneous snapshot of each timer's clock register is taken. This number represents the elapsed time on each of the timers. The difference, if any, is due to the tolerance between the frequency of two or more oscillators that are very accurate but do not oscillate at exactly the same frequency. Selecting one of the three timer elapsed times as absolute time, events recorded on the other two timers may be corrected to the selected time base. It is preferable to select the largest of the three elapsed times as the time base. The time of occurrence of events recorded on the other two timers are adjusted on a prorated basis according to the different timer elapsed times measured in the measurement of elapsed time phase. The response time of the valve can then be calculated as the difference between the time the switch initiated closing of the valve from the control room and the time the valve closed. In a similar manner, the response time of the pressure can be calculated relative to the closing of the switch or the closing of the valve.

A microprocessor could be used to store the recorded event times from synchronization and total elapsed time on each timer. A single microprocessor could then select the elapsed time to be used as absolute time and adjust each of the recorded event times as described above and calculate the response times.

Figure 8:
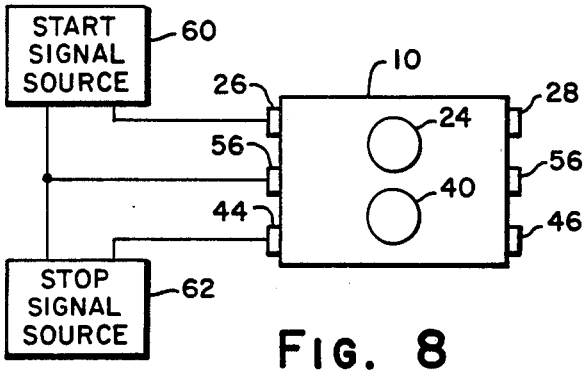
FIG. 8 is a schematic diagram showing the timer of FIG. 1 being used as a conventional timer.

A single timer as shown in FIG. 1 can be used in the configuration of FIG. 8 as a conventional timer. Start signal source 60 and stop signal source 62 must have a common ground 56 with timer 10.

The start pulse is generated by start signal source 60 and received by timer 10 at input terminal 26. The start pulse resets clock register 14 to the value at data-in terminal 20. The value at data-in terminal 20 is preferably 0.

The stop pulse is generated by stop signal source 62 and is received by timer 10 at input terminal 44. The stop pulse transfers the number stored in clock register 14 to snapshot register 30. Snapshot register 30 then contains the elapsed time between the start pulse and the stop pulse.

Figure 9:
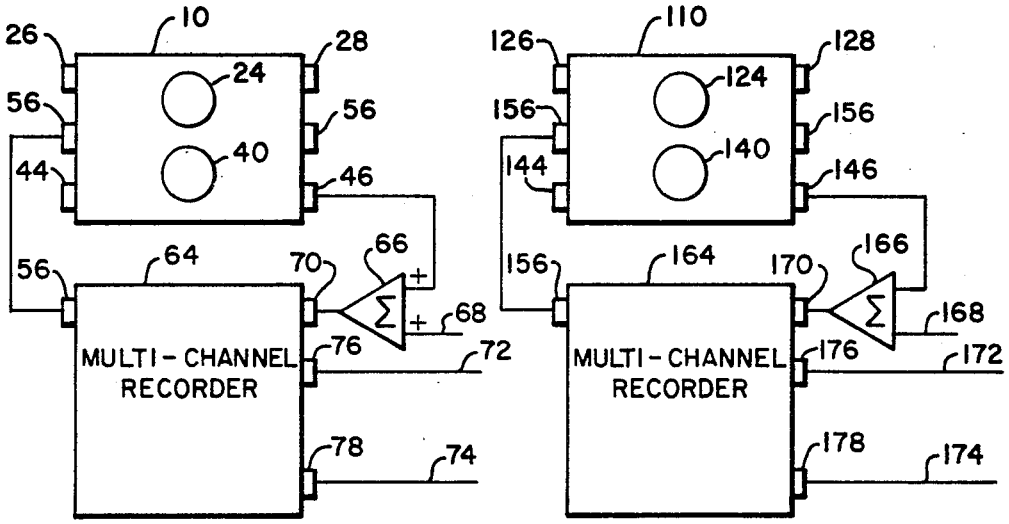
FIG. 9 is a schematic diagram showing two timers used to record analog signals on separate or electrically isolated recorders to a common time base.

FIG. 9 shows a configuration in which two timers can be used to record transient or analog signals to a common time base on physically separated or electrically isolated recorders. As with response time testing described above, this method of recording analog signals to a common time base can be extended to more than two timer-recorders with no signal transmission required between recording sites.

To record transients to a common time base, timers 10 and 110 are interconnected and synchronized in the synchronization or first phase in the same manner as in response time testing.

In the test or second phase, each timer is connected to a multi-channel strip chart or magnetic recorder to record one or more electrical signals. As shown in FIG. 9, timer 10 has a common ground 56 with multi-channel recorder 64. Output terminal 46 is connected as the first input to summing amplifier 66 to superimposed the snapshot register 30 reset signal on the first voltage signal 68 being recorded. Voltage signal 68 is the second input to summing amplifier 66. The output of summing amplifier 66 is recorded on the first channel 70 of recorder 64. Additional voltage signals 72 through 74 are recorded directly on remaining channels 76 through 78 of recorder 64.

Timer 110 and recorder 164 are wired in a manner similar to timer 10 and recorder 64. Timer 110 has a common ground 156 with multi-channel recorder 164. Output terminal 146 is connected as the first input to summing amplifier 166 to superimpose the snapshot register 130 reset signal on the first signal 168 being recorded. Signal 168 is the second input to summing amplifier 166. The output of summing amplifier 166 is recorded on the first channel 170 of recorder 164. Additional voltage signals 172 through 174 are recorded directly on remaining channels 176 through 178 of recorder 164.

After recorders 10 and 110 have been synchronized, wired to voltage signals 68, 72 through 74, 168 and 172 through 174 and have started, the transient is intiated. At any time after the recorders have started, but preferably before or soon after the transient starts, pushbutton switch 40 is momentarily depressed on timer 10 and pushbutton switch 140 is momentarily depressed on timer 110. This places a timing mark on first channel 70 of recorder 64 and also a timing mark on first channel 170 of recorder 164 and simultaneously transfers the corresponding time to the snapshot register and display of the respective timers. Each displayed time is manually recorded or recorded on the timer's printer. Several timing marks are recorded on each recorder 64 and 164 throughout the duration of the transient. The timing marks need not be recorded simultaneously on recorders 64 and 164.

In the elapsed time or third phase of recording transients to a common time base, timers 10 and 110 are brought back together, wired as shown in FIG. 6. The number stored in each of timers 10 and 110 clock registers 14 and 114 are simultaneously transferred to snapshot register 30 and 130 and recorded as in response time testing. Again, this value represents the elapsed time as measured by the respective timer.

In the correction or fourth phase of recording transients to a common time base, an analyst takes one of the elapsed times measured in the third phase as absolute time and modifies the times of the timing marks recorded during the second phase on the recorder not associated with the timer selected as the time base. This is similar to the fourth phase of response time testing. This procedure compensates for different recorder time bases as the analyst now knows the times of each recorded variable to the same time reference. There are many variations possible on the embodiment of FIG. 9. FIG. 9 shows the time mark being superimposed on one channel of information. An alternate embodiment would be to record the time mark on a separate channel. Other embodiments would include providing timers that are the time base for the recorder or timers that are an integral part of the recorder.

This timing system allows measurement of the elapsed time between many pairs of signals that are physically separated or electrically isolated. The time signal transmission between separated sources is not required. This timing system can be built with off-the-shelf components and is very flexible as all timers may be identical. All timers being identical is important because the number of timers required for response time testing of equipment will vary. This timing system is limited to the extent that clock register 14 and snapshot register 30 of timer 10 have sufficient capacity to accummulate the elapsed time and sufficient energy in self contained power supply 11 to provide power for that duration.

I claim:

1. A timing system for determining the time interval between the occurrence of an initiating event and a dependent event, comprising:

a first timing means comprising, a first power supply having a signal ground; a first oscillator for generating periodic clock pulses of a known frequency; a first resettable clock register for counting clock pulses generated by said first oscillator, powered by said first power supply; means for resetting said first clock register; a first snapshot register; means for initiating the transfer of the number of counted clock pulses stored in said first clock register to said first snapshot register; means for transferring the number of counted clock pulses stored in said first clock register to said first snapshot register; means for displaying said number of counted clock pulses stored in said first snapshot register;

a second timing means comprising, a second power supply having a signal ground; a second oscillator for generating periodic clock pulses of said known frequency, powered by said second power supply, a second resettable clock register for counting clock pulses generated by said second oscillator; means for resetting said second clock register; a second snapshot register; means for intiating the transfer of the number of counted clock pulses stored in said second clock register to said second snapshot register; means for transferring the number of counted clock pulses stored in said second clock register to said second snapshot register; means for displaying said number of counted clock pulses stored in said second snapshot register;

means for interconnecting said signal ground of said first power supply and said signal ground of said second power supply;

means for interconnecting said means for resetting said first clock register and said means for resetting said second clock register; and means for interconnecting said means for intiating the transfer of the number of counted clock pulses stored in said first clock register to said first snapshot register and said means for intiating the transfer of the number of counted clock pulses stored in said second clock register to said second snapshot register, whereby said first and second timing means are adapted to be interconnected for synchronization, capable of being separated for timing and adapted to be interconnected again subsequent to the timing to determine an absolute time.

2. The timing system as in claim 1: wherein said means for displaying said number of counted clock pulses stored in said first snapshot register includes a binary-to-decimal converter interposed between said first snapshot register and said display means.

3. The timing system as in claim 2: wherein said means for displaying said number of counted clock pulses stored in said first snapshot register includes a printer.

4. The timing system as in claim 1: wherein said means for displaying said number of counted clock pulses stored in said second snapshot register includes a binary-to-decmial converter interposed between said second snapshot register and said display means.

5. The timing system as in claim 4: wherein said means for displaying said number of counted clock pulses stored in said second snapshot register includes a printer.

6. The timing system as in claim 1: wherein said means for resetting said first clock register is a pushbutton switch.

7. The timing system as in claim 1: wherein said means for initiating the transfer of the number of counted clock pulses stored in said first clock register to said first snapshot register is a pushbutton switch.

8. A method of determining the time interval between an initiating event and a dependent event of a series of two or more associated, physically separated or electrically isolated events, which comprises the steps of: interconnecting a first and a second timer a first time; synchronizing said first and said second timers while interconnected; disconnecting said first and said second timers; recording the elapsed time from synchronization to each of the initiating event and dependent event of the series of two or more associated events, one on each of said first and said second timers; interconnecting said first and said second timers a second time; and measuring simultaneously the elapsed time on said first and said second timers, so that the elapsed time of the timer with the larger elapsed time may be taken as absolute time, the event times on the timer with the smaller elapsed time adjusted and the response times calculated.

* * * * *